US007860642B2

(12) United States Patent
Sandell et al.

(10) Patent No.: US 7,860,642 B2
(45) Date of Patent: Dec. 28, 2010

(54) SEAMLESS AIR TRAFFIC CONTROL (ATC) DATALINK TRANSFERS

(75) Inventors: Gordon R. Sandell, Bothell, WA (US); Stephen Y. Lee, Shoreline, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 12/569,339

(22) Filed: Sep. 29, 2009

(65) Prior Publication Data

US 2010/0023247 A1 Jan. 28, 2010

Related U.S. Application Data

(62) Division of application No. 11/552,066, filed on Oct. 23, 2006, now Pat. No. 7,647,139.

(60) Provisional application No. 60/741,851, filed on Dec. 2, 2005.

(51) Int. Cl.
*G08G 5/04* (2006.01)

(52) U.S. Cl. ..... 701/120

(58) Field of Classification Search ..... 701/120, 701/117; 342/33, 36, 456
See application file for complete search history.

(56) References Cited

U.S. PATENT DOCUMENTS

| | | | | |
|---|---|---|---|---|
| 4,104,512 | A | 8/1978 | Strayer | |
| 4,196,474 | A * | 4/1980 | Buchanan et al. | 701/301 |
| 4,949,267 | A | 8/1990 | Gerstenfeld et al. | |
| 4,979,137 | A | 12/1990 | Gerstenfeld et al. | |
| 5,200,901 | A * | 4/1993 | Gerstenfeld et al. | 701/120 |
| 5,659,475 | A * | 8/1997 | Brown | 701/120 |
| 5,740,047 | A | 4/1998 | Pilley et al. | |
| 5,835,059 | A | 11/1998 | Nadel et al. | |

(Continued)

FOREIGN PATENT DOCUMENTS

| | | |
|---|---|---|
| EP | 1318492(A2) | 6/2003 |

(Continued)

OTHER PUBLICATIONS

Bousquie, "Data Link Communications: Operational & Human Factors Considerations", Digital Avionics Systems Conf, Oct. 1999, 8 pages.

(Continued)

*Primary Examiner*—Yonel Beaulieu
(74) *Attorney, Agent, or Firm*—Lee & Hayes, PLLC

(57) ABSTRACT

Embodiments for seamless air traffic control (ATC) data link transfers are disclosed. In at least one embodiment, a method includes receiving a new air traffic control center designation from an original air traffic control center through an active connection. The active connection is based on a first data link standard. The method further includes initiating control transfer by at least one of an aircraft logon to a new air traffic control center or a contact between the original and new traffic control centers. The method additional includes establishing an inactive connection between the new air traffic control center and the aircraft based on a second link standard. The method also includes confirming the establishment of an inactive connection from the aircraft to the new air traffic control center. Additionally, the method includes terminating the active connection between the original air traffic control center and the aircraft.

17 Claims, 5 Drawing Sheets

U.S. PATENT DOCUMENTS

| | | | | |
|---|---|---|---|---|
| 5,961,568 | A | 10/1999 | Farahat | |
| 6,044,323 | A | 3/2000 | Yee et al. | |
| 6,064,939 | A | 5/2000 | Nishida et al. | |
| 6,161,097 | A * | 12/2000 | Glass et al. | 705/6 |
| 6,173,230 | B1 | 1/2001 | Camus et al. | |
| 6,275,767 | B1 | 8/2001 | Delseny et al. | |
| 6,278,396 | B1 | 8/2001 | Tran | |
| 6,278,965 | B1 * | 8/2001 | Glass et al. | 703/22 |
| 6,313,759 | B1 | 11/2001 | Musland-Sipper | |
| 6,353,779 | B1 | 3/2002 | Simon et al. | |
| 6,393,281 | B1 | 5/2002 | Capone et al. | |
| 6,507,782 | B1 | 1/2003 | Rumbo et al. | |
| 6,552,669 | B2 | 4/2003 | Simon et al. | |
| 6,677,888 | B2 | 1/2004 | Roy | |
| 6,828,921 | B2 | 12/2004 | Brown et al. | |
| 7,047,112 | B2 | 5/2006 | Riedel et al. | |
| 2003/0009278 | A1 | 1/2003 | Mallet et al. | |
| 2003/0030581 | A1 | 2/2003 | Roy | |
| 2003/0034422 | A1 | 2/2003 | Higgins | |
| 2003/0193408 | A1 | 10/2003 | Brown et al. | |
| 2005/0181787 | A1 | 8/2005 | Judd et al. | |
| 2007/0159356 | A1 | 7/2007 | Borel et al. | |

FOREIGN PATENT DOCUMENTS

| | | |
|---|---|---|
| WO | WO02099769(A1) | 12/2002 |
| WO | WO03021977 A2 | 3/2003 |

OTHER PUBLICATIONS

Eurocontrol Standard Document for On-Line Data Interchange, European Air Traffic Management Programme, Oct. 2003, 6 pgs.

Sandell, "Datalink on the 787 Airplane," ATN 2005, Sep 20, 2005, 42 pages, London.

Tamalet, "Airbus FANS B Project Presentation", Aeronautical Communiations Panel (ACP) Working Group N, 4th Meeting, Nov. 2004, pp. 1-9.

Signore et al., "A Simplified Aeronautical Telecommunication Network (ATN) Avionics Architecture", Digtital Avionics Systems Conf. Oct./Nov. 1998, Proceedings 17th DASC. The AIAA/IEEE/SAE, 5 pgs.

Signore et al, "The Aeronautical Telecommunication Network (ATN)", Military Communications Conf. Oct. 1998, MILCOM 98, Proceedings, IEEE Boston, MA, 5 pages.

* cited by examiner

SEAMLESS AIR TRAFFIC CONTROL (ATC) DATALINK TRANSFERS

CROSS REFERENCE TO RELATED APPLICATIONS

This patent application is a divisional application of U.S. Pat. No. 7,647,439, issued on Jan. 20, 2010 entitled "Seamless Air Traffic Control (ATC) Datalink Transfers", which claims priority from U.S. Provisional Application No. 60/741,851 entitled "Seamless ATC Datalink Transfers" filed on Dec. 2, 2005, which are incorporated herein by reference.

FIELD OF THE INVENTION

This invention relates to systems and methods for air traffic control, and more specifically, to systems and methods for communication using a plurality of different air traffic control data link standards.

BACKGROUND OF THE INVENTION

Air Traffic Control data links presently use two generally incompatible technologies, Future Air Navigation System (FANS), which is used in oceanic and remote airspace, and Aeronautical Telecommunications Network (ATN), which is used in continental Europe and potentially in other congested domestic environments. Typically, an aircraft system is either equipped with the FANS data link technology and associated operator interface, or the ATN data link technology and associated operator interface.

Although desirable results have been achieved using such prior art systems, there may be room for improvement. For example, the current ability to implement just a single data link technology on an aircraft means that air traffic control over the aircraft can only be transferred between air traffic control centers that utilize the same data link technology. Therefore, novel systems and methods that allow the utilization of a plurality of different (air traffic control) ATC data link technologies on a single aircraft, as well as novel systems and methods that facilitate the automated transfer of air traffic control over an aircraft between ATC centers that utilize different data link technologies would be highly desirable.

SUMMARY OF THE INVENTION

The present invention is directed to systems and methods for automatically transferring control from one air traffic control (ATC) center that uses one ATC data link standard to another ATC center that uses a different ATC data link standard. Embodiments of systems and methods in accordance with the present invention may advantageously facilitate the implementation of multiple air traffic control data link technologies on a single aircraft, and may allow greater flexibility in the deployment of aircraft in different geographical regions, in comparison with the prior art.

In at least one embodiment, a method for seamless air traffic control (ATC) data link transfers includes receiving a new air traffic control center designation from an original air traffic control center through an active connection. The active connection is based on a first data link standard. The method further includes initiating control transfer by at least one of an aircraft logon to a new air traffic control center or a contact between the original and new traffic control centers. The method additional includes establishing an inactive connection between the new air traffic control center and the aircraft based on a second link standard. The method also includes confirming the establishment of an inactive connection from the aircraft to the new air traffic control center. Additionally, the method includes terminating the active connection between the original air traffic control center and the aircraft.

BRIEF DESCRIPTION OF THE DRAWINGS

Embodiments of the present invention are described in detail below with reference to the following drawings.

DETAILED DESCRIPTION

The present invention relates to systems and methods for automatically transferring control from one air traffic control (ATC) center that uses one ATC data link standard to another ATC center that uses a different ATC data link standard. Many specific details of certain embodiments of the invention are set forth in the following description and in FIGS. 1-5 to provide a thorough understanding of such embodiments. The present invention may have additional embodiments, or may be practiced without one or more of the details described below.

Generally, embodiments of systems and methods in accordance with the present invention provide systems and methods for automatically transferring control between two ATC centers that use different ATC data link standards. The systems and methods advantageously allow automatic transfers of an aircraft from one ATC center to the next ATC center without flight crew interaction. Furthermore, the mechanisms of the system and methods rely on the ground facility's uplinks to determine the type of connection to establish. As a result, if a particular control center has FANS as well as ATN data link capabilities, it can determine whether to connect as an ATN or FANS center to the aircraft. Thus, embodiments of the invention advantageously facilitate the implementation of multiple air traffic control data link technologies on a single aircraft, and may allow greater flexibility in the deployment of aircraft in different geographical regions, in comparison with the prior art.

Figure 1:
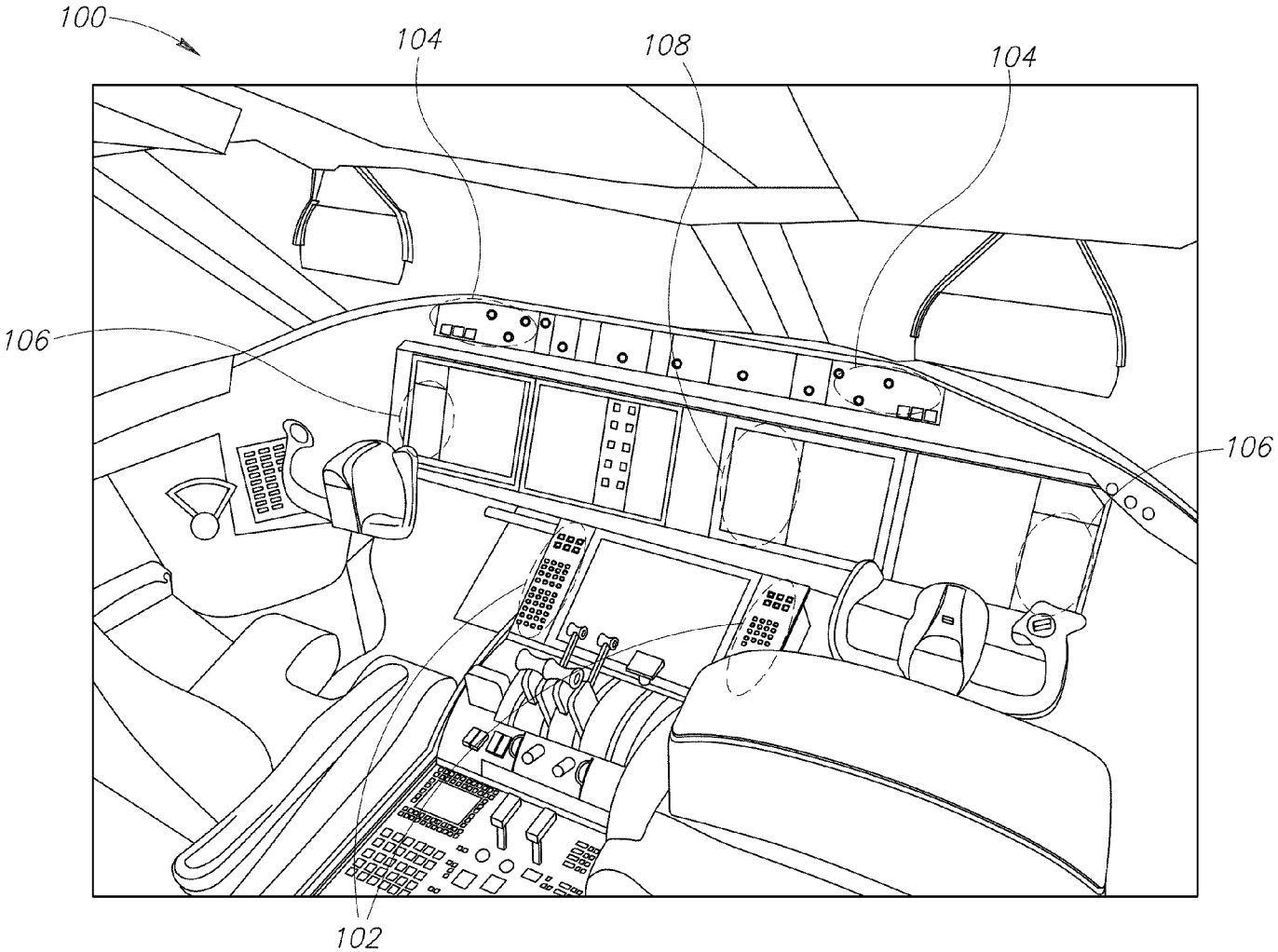
FIG. 1 is an isometric view of an aircraft cockpit equipped with a communications system in accordance with an embodiment of the invention.

FIG. 1 is an isometric view of an aircraft cockpit 100 operatively linked with a system for automatically transferring control between two ATC centers that use different ATC data link standards, in accordance with an embodiment of the invention. The cockpit is also outfitted with a single ATC operator interface communications system. This system works in conjunction with the ATC data link transfers system of the present invention to allow communication via a plurality of data link standards. The single ATC operator communication system is described in U.S. Pat. No. 7,495,602, issued on Feb. 24, 2009, which is incorporated herein by reference. In this embodiment, the aircraft cockpit 100 is equipped with a plurality of keyboards and cursor pointers 102 for data link entry and selection, a plurality of buttons (accept, reject, cancel, etc.) 104 on the glare shield for each crew member, a plurality of automatic uplink displays 106, and at least one common user interface display 108 for ATC and Aircraft Operational Communication (AOC) data links.

Figure 2:
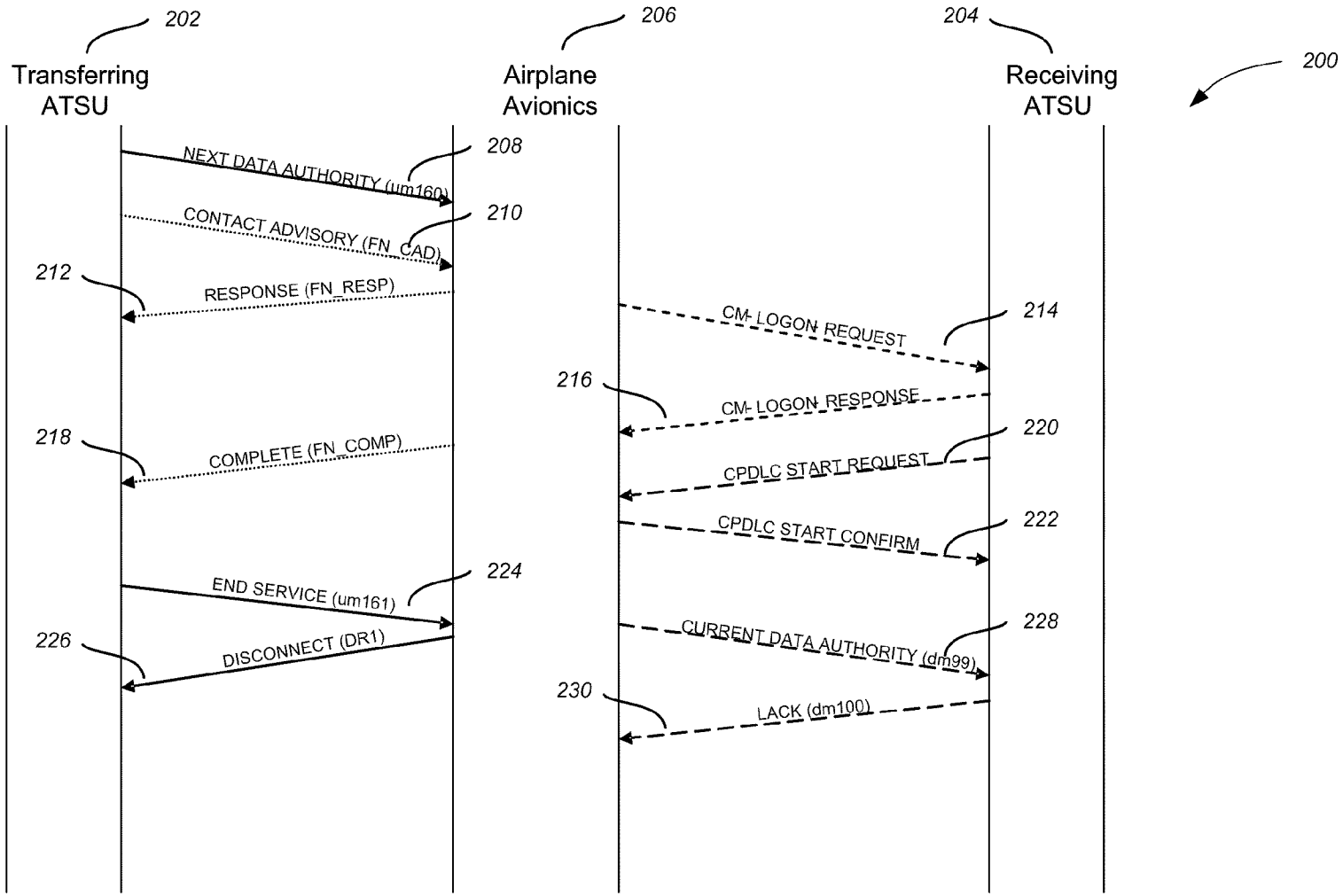
FIG. 2 is a schematic representation of a control transfer from a FANS center to an ATN center, in accordance with an embodiment of the invention.

FIG. 2 is a schematic representation 200 of a control transfer from a FANS center (transfer air traffic services unit, a.k.a. transfer ATSU) 202 to an ATN center (transfer ATSU) 204, in accordance with an embodiment of the invention. As illustrated in FIG. 2, FANS Controller/Pilot Data Link Communication (CPDLC) messages are represented by solid lines, e.g., step 206. Air Traffic Services (ATS) Facilities Notification (AFN) messages are represented by dotted lines, e.g., step 210. Context Management (CM) messages are represented by short dash lines, e.g., step 212. Lastly, ATN CPDLC messages are represented by long dash lines, e.g., step 218.

The process initiates at step 208, when the FANS center 202 sends a FANS CPDLC "NEXT DATA AUTHORITY" message (uplink message 160) to an aircraft, where it is received by avionics 206. The next control center designated by this message (in this case ATN center 204) is treated by both FANS and ATN CPDLC applications of the aircraft avionics 206 as a next data authority. It will be appreciated that because of the limitations of the FANS Facility Designation parameter, the designation of an ATN center, such as ATN center 204, can only occur if the center has a 4-character ICAO identifier (whereas ATN allows 4-8 characters). Thus, step 208 is limited to transfers to ATN centers having a 4-character ICAO identifier. Next, the FANS center 202 also sends an AFN Contact Advisory Message to the aircraft at step 210, and the airplane avionics 206 responds with an AFN response at step 212. Normally, the address in the AFN Contact Advisory Message sent at step 210 is the 7-character Aircraft Communication Addressing and Reporting System (ACARS) address of the facility. For this purpose, the 3 characters "ATN" are appends to the 4-character ICAO identifier, indicating that the next center is an ATN center.

Meanwhile, the aircraft avionics 206 then determines from at least one of the "NEXT DATA AUTHORITY" message or the AFN contact advisory message that the next air traffic control center is an ATN center, in this case, ATN 204. Next, the aircraft avionics 206 sends a Context Management Logon Request to the ATN center 204 at step 214, using the address of the ATN center 204 from an on-board database. At step 216, The ATN center 204 responds to the aircraft with a Context Management Logon Response. On receipt of the Context Management logon response, and with the knowledge that it is responding to a logon request issued as a result of an AFN Contact Advisory, the aircraft avionics 206 sends the AFN Complete message to the FANS center at step 218. The process then continues to step 220, at which point the ATN center 204 initiates a CPDLC Start Request to the aircraft, upon which the aircraft avionics 206 responds with a Start Confirm at step 222. At this point, the FANS application has an active CPDLC connection, and the ATN application has an inactive (next center) connection. It will be appreciated that at this point, the receipt of another "Next Data Authority" message by the aircraft avionics 206 will terminate the inactive connection between the aircraft and the ATN center 204, just as it does in an ATN center to ATN center transfer, or a FANS center to FANS center transfer.

However, if the transfer process continues from step 222, FANS center 2042 will send an End Service message at step 224. This message terminates the existing FANS connection (resulting in the Disconnect Request to the FANS center 202) at step 226, and turns the inactive connection with the ATN center, established using steps 220 and 222, into an active one. It will be appreciate that this embodiment encompasses a simple transfer. In other embodiments, a message that requires a WILCO response may be included as part of the transfer process, and the termination of the existing FANS connection and the transfer of the connection to the next ATN center only occurs when the WILCO is sent. Once steps 222 and 224 are complete, the aircraft avionics 206 sends a Current Data Authority message to the ATN center at step 228 indicating it has an active connection, and the ATN center responds with a Logical Acknowledgement (LACK) at step 230, in the same fashion as during an ATN center to ATN center control transfer.

It will be appreciated that in another embodiment of the FANS center to ATN center control transfer process, steps 208 and 210 may be reversed from the aircraft perspective. In this embodiment, the only requirement from the perspective of the aircraft is that step 208 must be completed prior to step 216. In another embodiment, steps 210, 212, 214, 216, and 218 may be replaced by a ground-to-ground Contact Management Contact Process, without involvement of the aircraft avionics 206. In other words, if the FANS center 202 chooses to do so, FANS center 202 may substitute steps 210, 212, 214, 216, and 218 with a direct Context Management Contact process to indicate to the ATN center 204 that it may start the control transfer process and initiate step 220.

In yet another embodiment of the FANS center to ATN center control transfer process, the ATN center 404 may initiate a FANS Automatic Dependent Surveillance (ADS) connection to an aircraft at any time during the process. For example, the FANS ADS connection may be initiated to obtain the NEXT and NEXT+1 waypoints. To achieve this, the ATN center needs the aircraft registration (from the filed flight plan) and the aircraft type to determine which set of standard message identifiers (SMIs) to use. The SMIs differ depending on whether a particular aircraft model has the Air Traffic Services (ATS) function hosted in the Communications Management Unit (CMU) or elsewhere, such as the Flight Management Computer (FMC). An ATN center may obtain this information (aircraft registration and SMI) from a database it maintains, from the aircraft model in the filed flight plan, or from the center that initiated the control transfer. Currently proposed modifications to the Aeronautical Interfacility Data Communication (AIDC) message set would also provide this information. Lastly, in a final embodiment of the control center transfer process, a connection request received by the FANS CPDLC application of the aircraft from a valid NEXT DATA AUTHORITY establishes an inactive next center connection, regardless of whether the FANS CPDLC application has an active connection to another center.

Figure 3:
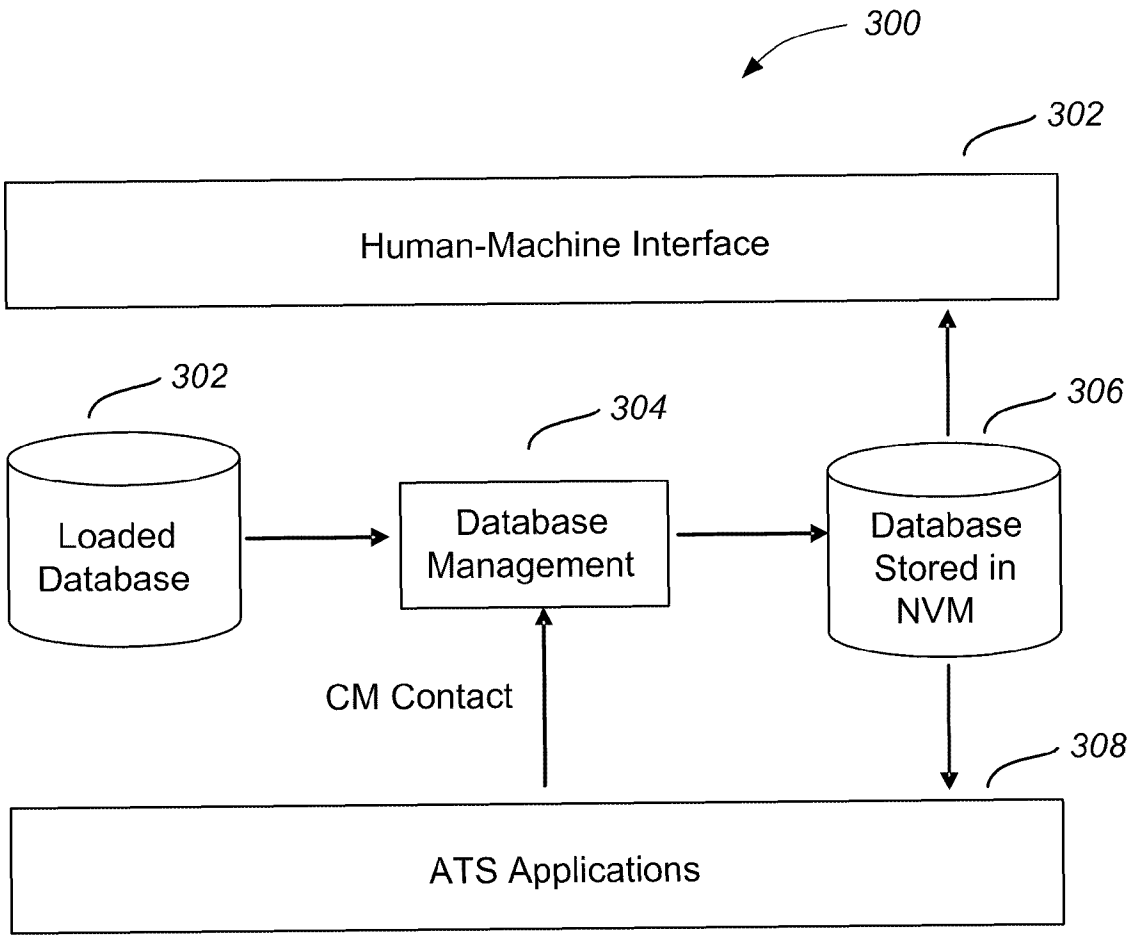
FIG. 3 is a schematic representation of an embodiment of a database system in accordance with an embodiment of the invention.

FIG. 3 is a schematic representation of an embodiment of a database system 300 that may be used to determine whether a center is a FANS center or ATN center. It may also be used to determine the addressing information of a particular ATN air traffic control center. As depicted in FIG. 3, the database system 300 includes a database management component 304. An initial database 302 is loaded into the system and coupled to the database management component 304. The data in database 302 may typically be stored in non-volatile memory (NVM) 306. An ATS applications component 308 uses the data stored in NVM 306 to obtain addressing information. A minor change to the AFN protocols to allow use of 4-character ATC center identifier, rather than a 7-character ACARS address, is necessary for the implementation of the database system 300. In addition, the ground system must also use appropriate default values for ATN addresses when a Context Management message specifies a FANS center.

In some embodiments, the database 302 and NVM 306 may be updated by information contained in Context Management (CMA) contact messages received by the database management component 304. The database 302 and NVM 306 may also be updated by blind contact messages, that is, contact message received without having the aircraft equipped initiated a Context Management logon to an air traffic services unit (ATSU). Reloading the database 302 or the data link application software would delete any updated information, and the airplane would start with the data in the loaded database 302.

Figure 4:
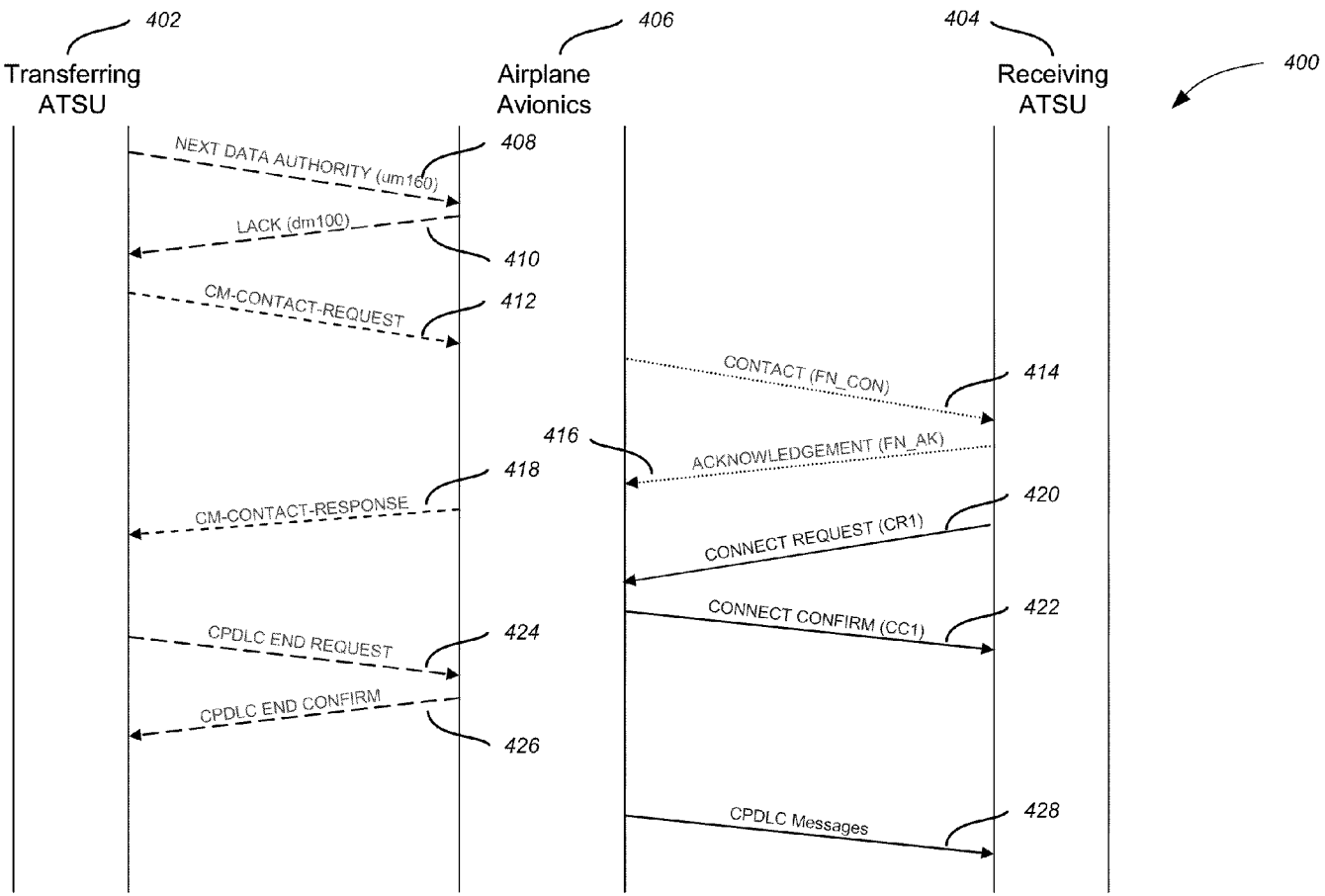
FIG. 4 is a schematic representation of a control transfer from an ATN center to a FANS center, in accordance with an embodiment of the invention.

FIG. 4 is a schematic representation 400 of a transfer from an ATN center (transfer ATSU) 402 to a FANS center (transfer ATSU) 404, in accordance with an embodiment of the invention. As illustrated in FIG. 4, FANS CPDLC messages are represented by solid lines, e.g., step 420. AFN messages are represented by dotted lines, e.g., step 414. Context Management messages are represented by short dash lines, e.g., step 412. Lastly, ATN CPDLC messages are represented by long dash lines, e.g., step 424.

The process initiates at step 408, when the ATN center 402 sends an ATN CPDLC "NEXT DATA AUTHORITY" message (uplink message 160) to an aircraft, where it is received by aircraft avionics 406. The next control center designated by this message (in this case FANS center 404) is treated by both the FANS and ATN CPDLC applications of the aircraft avionics 406 as a next data authority. It will be appreciated that if the next control center has an ICAO identifier longer than 4 characters, the aircraft avionics 406 will identify the next control center as an ATN center. This is due to the fact that FANS center identifiers are limited 4 characters. In response to the message of step 408, the aircraft avionics 406 responds with a Logical Acknowledgement (if not prohibited) at step 410.

Next, at step 412, the ATN center 402 sends a CM Contact Request message to the aircraft. The address in the uplink will be all zeros, and the facility identifier will contain the 7-character ACARS address of the next control center. Once the aircraft avionics 406 determines (from the all-zero address) that the identified center is a FANS center, in this case FANS center 404, the aircraft avionics 406 sends an AFN Contact message to the FANS center 404 using the 7-character facility identifier in the message at step 414. In turn, the FANS center 404 responds with an AFN Acknowledgement at step 416. Further, once the aircraft receives the AFN acknowledgement, and with the knowledge that it is responding to an AFN Contact message issued as a result of a CM Contact Request message, the aircraft avionics 406 sends the Contact Response message to the initiating ATN center 402 at step 418.

The process continues when the FANS ground center sends a CPDLC Connect Request (CR1) to the aircraft avionics 406 at step 420. In response to the connection request, the aircraft responds with a Connect Confirm (CC1), in the same fashion as it would acknowledge any other FANS connection request, at step 422. At this point, the ATN application has an active CPDLC connection, and the FANS application has an inactive (next center) connection. It will be appreciate that at this point, the receipt of another NEXT DATA AUTHORITY message will terminate the inactive connection.

However, if the transfer process continues from step 422, the ATN center 402 sends a CPDLC End Request message at step 424. This terminates the existing ATN connection (resulting in the Confirm End message to the ATN center at step 426), and turns the inactive connection with the FANS center, established at step 420, into an active one. Once step 424 is complete, the aircraft reacts just as in a transfer from a FANS center to the next FANS center. Both the aircraft avionics 406 and the FANS center 404 may now initiate CPDLC messages, as shown in step 428. It will be further appreciated that the usual procedure in FANS airspace is to send a position report on crossing an FIR boundary, to indicate that communication with the new center has been established.

In another embodiment of the invention, steps 408 and 412 may be reversed from the aircraft perspective. The only requirement from the perspective of the aircraft is that Step 408 must be completed prior to Step 420. In another embodiment, Steps 412, 414, 416, and 418 may be replaced by a ground-to-ground AFN contact advisory transaction, without involvement of the aircraft avionics 406. In other words, if the ATN center 402 chooses to do so, ATN center 402 may substitute steps 412, 414, 416, and 418 with a direct AFN contact advisory transaction to indicate to the FANS center 404 that it may start the control transfer process and initiate step 420.

It will be appreciated that when an aircraft transfers from one control center to another, open uplink and downlinks, that is, those having a response enabled per the defining standards, (i.e., ROGER, WILCO/UNABLE, or AFFIRMATIVE/NEGATIVE) are automatically aborted. As a result, there are no issues for a FANS-1/A to ATN control transfer, or vice versa, with respect to these links. Nevertheless, there are other situations where an uplink request can result in a report being transmitted. If this has not occurred before the control transfer, existing systems (i.e., FANS to FANS or ATN to ATN) will transmit the report (if sent manually by the crew or automatically by having been armed) to the new center. However, with respect to a FANS-1/A to ATN control transfer, or vice versa, the differing data link standards can potentially result in an automatically transmitted report that is not defined for a new center's message set or a report that is subtly different. Therefore, for a FANS-1/A to ATN transfer, or vice versa, "open" reports should be aborted. Lastly, in a final embodiment of the control center transfer process, a connection request received by the ATN CPDLC application of the aircraft from a valid NEXT DATA AUTHORITY establishes an inactive next center connection, regardless of whether the ATN CPDLC application has an active connection to another center.

Figure 5:
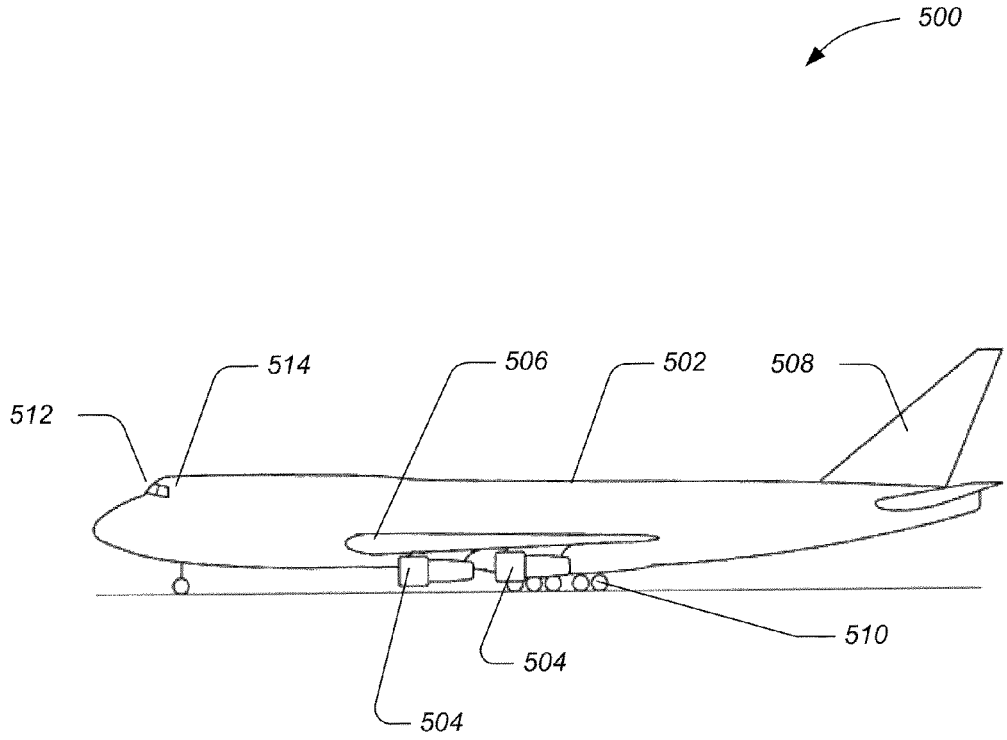
FIG. 5 is a side elevational view of an aircraft in accordance with another embodiment of the invention.

Embodiments of the present invention may be used in a wide variety of aircrafts. For example, FIG. 5 is a side elevational view of an aircraft 500 in accordance with an embodiment of the present invention. In general, except for one or more systems in accordance with the present invention, the various components and subsystems of the aircraft 500 may be of known construction and, for the sake of brevity, will not be described in detail herein. As shown in FIG. 5, the aircraft 500 includes one or more propulsion units 504 coupled to a fuselage 502, a cockpit 512 in the fuselage 502, wing assemblies 506 (or other lifting surfaces), a tail assembly 508, a landing assembly 510, a control system (not visible), and a host of other systems and subsystems that enable proper operation of the aircraft 500. At least one ATC data link transfer system 514 formed in accordance with the present invention is located within the fuselage 502. However, additional ATC data link transfer system 514 and components thereof may be distributed throughout the various portions of the aircraft 500.

Although the aircraft 500 shown in FIG. 5 is generally representative of a commercial passenger aircraft, including, for example, the 737, 747, 757, 767, 777, and 787 models commercially-available from The Boeing Company of Chicago, Ill., the inventive apparatus and methods disclosed herein may also be employed in the assembly of virtually any other types of aircraft. More specifically, the teachings of the present invention may be applied to the manufacture and assembly of other passenger aircraft, cargo aircraft, rotary aircraft, and any other types of aircraft, including those described, for example, in The Illustrated Encyclopedia of Military Aircraft by Enzo Angelucci, published by Book Sales Publishers, September 2001, and in Jane's All the World's Aircraft published by Jane's Information Group of Coulsdon, Surrey, United Kingdom, which texts are incorporated herein by reference. It may also be appreciated that alternate embodiments of system and methods in accordance with the present invention may be utilized in other manned aerial vehicles.

Embodiments of systems and methods in accordance with the present invention may provide significant advantages over the prior art. For example, because the data link transfer system allows automatic transfers of an aircraft from one ATC center to the next ATC center without flight crew interaction, it facilitates the implementation of multiple air traffic control data link technologies on a single aircraft. More significantly, the data link transfer system advantageously allows greater flexibility in the deployment of aircrafts to airspace in different geographical regions.

While embodiments of the invention have been illustrated and described above, many changes can be made without departing from the spirit and scope of the invention. Accordingly, the scope of the invention is not limited by the disclosure of these embodiments. Instead, the invention should be determined entirely by reference to the claims that follow.

What is claimed is:

1. A method for transferring air traffic control over an aircraft, comprising:

receiving a new air traffic control center designation from an original air traffic control center through an active connection, wherein the active connection is based on a first data link standard;

initiating control transfer by at least one of an aircraft logon to a new air traffic control center and a contact between the original and new traffic control centers;

establishing an inactive connection between the new air traffic control center and the aircraft based on a second link standard;

confirming the establishment of an inactive connection from the aircraft to the new air traffic control center; and terminating the active connection between the original air traffic control center and the aircraft.

2. The method of claim 1, wherein terminating an active traffic control connection between the original air traffic control center and the aircraft activates the inactive connection between the aircraft and the new air traffic control center.

3. The method of claim 2, wherein the second data link standard is the Aeronautical Telecommunication Network (ATN) standard, and wherein activating the inactive connection between the aircraft and the new traffic control center includes sending a message confirming an active ATN connection from the aircraft to the new air traffic control center.

4. The method of claim 1, wherein initiating control transfer by an aircraft logon includes using one of a Context Management (CM) contact process to prompt the aircraft to perform an Aeronautical Telecommunication Network (AFN) logon to the new control center, and using an AFN contact advisory process to prompt the aircraft to perform an CM logon to the new air traffic control center.

5. The method of claim 1, wherein initiating control transfer by a contact between the original and new traffic control centers includes one of completing an Airway Facilities Notification (AFN) contact advisory transaction between the original air traffic control center and the new air traffic control center, and completing a Context Management (CM) contact transaction between the original air traffic control center and the new air traffic control center.

6. The method of claim 1, wherein the second data link standard is a Future Air Navigation System (FANS) standard when the first data link standard is an Aeronautical Telecommunication Network (ATN) standard, and wherein the second data link standard is an ATN standard when the first data link is an FANS standard.

7. The method of claim 1, wherein logging the aircraft on to the new air traffic control center includes determining an address for the new air traffic control center from a database if the second data link standard is an Aeronautical Telecommunication Network (ATN) standard.

8. The method of claim 1, further comprising determining the second link standard from one of an Airway Facilities Notification (AFN) Contact Advisory message or a Context Management (CM) Contact Request message.

9. The method of claim 1, further comprising logging on to the new air traffic control center by one of performing an Airway Facilities Notification (AFN) logon when prompted by a Context Management (CM) contact process or performing a CM logon when prompted by an AFN contact advisory process.

10. A method for transferring air traffic control over an aircraft, comprising:

receiving a new air traffic control center designation from an original air traffic control center through an active connection, wherein the active connection is based on a first data link standard;

initiating control transfer by at least one of an aircraft logon to a new air traffic control center and a contact between the original and new traffic control centers;

establishing an inactive connection between the new air traffic control center and the aircraft based on a second link standard;

confirming the establishment of an inactive connection from the aircraft to the new air traffic control center; and terminating the active connection between the original air traffic control center and the aircraft, wherein the first data link standard is one of a Future Air Navigation System (FANS) standard and an Aeronautical Telecommunication Network (ATN) standard, and wherein the second data link standard is one of a FANS standard and an ATN standard,

11. The method of claim 10, wherein terminating an active traffic control connection between the original air traffic control center and the aircraft activates the inactive connection between the aircraft and the new air traffic control center.

12. The method of claim 11, wherein the second data link standard is the Aeronautical Telecommunication Network (ATN) standard, and wherein activating the inactive connection between the aircraft and the new traffic control center includes sending a message confirming an active ATN connection from the aircraft to the new air traffic control center.

13. The method of claim 10, wherein initiating control transfer by an aircraft logon includes using one of a Context Management (CM) contact process to prompt the aircraft to perform an Airway Facilities Notification (AFN) logon to the new control center, and using an AFN contact advisory process to prompt the aircraft to perform an CM logon to the new air traffic control center.

14. The method of claim 10, wherein initiating control transfer by a contact between the original and new traffic control centers includes one of completing a Airway Facilities Notification (AFN) contact advisory transaction between the original air traffic control center and the new air traffic control center, and completing an Context Management (CM) contact transaction between the original air traffic control center and the new air traffic control center.

15. The method of claim 10, wherein logging the aircraft on to the new air traffic control center includes determining an address for the new air traffic control center from a database if the second data link standard is an Aeronautical Telecommunication Network (ATN) standard.

16. The method of claim 10, further comprising determining the second link standard from one of an Airway Facilities Notification (AFN) Contact Advisory message or a Context Management (CM) Contact Request message.

17. The method of claim 10, further comprising logging on to the new air traffic control center by one of performing an Airway Facilities Notification (AFN) logon when prompted by a Context Management (CM) contact process or performing a CM logon when prompted by an AFN contact advisory process.

* * * * *